US010699889B2

(12) United States Patent
Slater et al.

(10) Patent No.: US 10,699,889 B2
(45) Date of Patent: Jun. 30, 2020

(54) ION GUIDE

(71) Applicant: MICROMASS UK LIMITED, Wilmslow (GB)

(72) Inventors: Stephen Patrick Slater, Rochdale (GB); John Iveson, Failsworth (GB); Oliver John Malpas, Congleton (GB); Bharat Chande, Dunkinfield (GB); David Gordon, Middlewich (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 16/301,428

(22) PCT Filed: May 15, 2017

(86) PCT No.: PCT/GB2017/051348
§ 371 (c)(1),
(2) Date: Nov. 13, 2018

(87) PCT Pub. No.: WO2017/194974
PCT Pub. Date: Nov. 16, 2017

(65) Prior Publication Data

US 2019/0287779 A1 Sep. 19, 2019

(30) Foreign Application Priority Data

May 13, 2016 (GB) ..... 1608476.6

(51) Int. Cl.
*H01J 49/06* (2006.01)
*H01J 49/02* (2006.01)

(52) U.S. Cl.
CPC ..... *H01J 49/065* (2013.01); *H01J 49/022* (2013.01); *H01J 49/063* (2013.01)

(58) Field of Classification Search
CPC ..... H01J 49/065; H01J 49/022; H01J 49/063
(Continued)

(56) References Cited

U.S. PATENT DOCUMENTS 5,572,035 A 11/1996 Franzen
6,015,972 A 1/2000 Hager
(Continued)

FOREIGN PATENT DOCUMENTS

EP 1465234 A2 10/2004
EP 2131386 A1 9/2009
(Continued)

OTHER PUBLICATIONS

International Search Report and Written Opinion for International Application No. PCT/GB2017/051348 dated Aug. 2, 2017, 13 pages.

(Continued)

*Primary Examiner* — Nicole M Ippolito

(57) ABSTRACT

Disclosed herein is an ion guide comprising a plurality of axially stacked plates, wherein at least some or all of said plates comprise: a first electrically conductive portion; and a second electrically conductive portion, wherein the second electrically conductive portion is electrically isolated from the first electrically conductive portion, the first and second electrically conductive portions being shaped and arranged relative to each other so as to define an opening through which ions are axially transmitted in use; wherein, in use, a first AC or RF voltage is applied to the first electrically conductive portion and a second AC or RF voltage is applied to the second electrically conductive portion in order to confine ions radially within said opening. The first and second electrically conductive portions (1, 2) may be separately formed and interleaved within the ion guide to define the plates. Alternatively the first (41, 43) and second (42, 44) electrically conductive portions may be printed onto a common substrate (4).

14 Claims, 2 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 6,762,404 | B2 | 7/2004 | Bateman et al. | |
| 6,794,641 | B2 | 9/2004 | Bateman et al. | |
| 6,911,650 | B1 | 6/2005 | Park | |
| 7,198,353 | B2 | 4/2007 | Hart et al. | |
| 7,227,137 | B2 | 6/2007 | Londry et al. | |
| 8,519,331 | B2 | 8/2013 | Bateman et al. | |
| 8,658,970 | B2 | 2/2014 | Kenny | |
| 2001/0054688 | A1 | 12/2001 | Waki | |
| 2003/0132379 | A1 | 7/2003 | Li | |
| 2003/0173524 | A1 | 9/2003 | Syka | |
| 2004/0195503 | A1 | 10/2004 | Kim et al. | |
| 2004/0211897 | A1 | 10/2004 | Kim et al. | |
| 2006/0016981 | A1 | 1/2006 | Park | |
| 2006/0076485 | A1 | 4/2006 | Stoermer et al. | |
| 2007/0272848 | A1 | 11/2007 | Franzen | |
| 2010/0096541 | A1 | 4/2010 | Okumura et al. | |
| 2013/0175441 | A1 | 7/2013 | Zanon et al. | |
| 2014/0166895 | A1 | 6/2014 | Kenny | |
| 2015/0364309 | A1* | 12/2015 | Welkie ..... | H01J 49/062 250/282 |
| 2016/0126078 | A1* | 5/2016 | Liepert ..... | H01J 49/0022 250/282 |

FOREIGN PATENT DOCUMENTS

| | | | |
|---|---|---|---|
| EP | 2124246 | A1 | 11/2009 |
| GB | 2418528 | A | 3/2006 |
| GB | 2422051 | A | 7/2006 |
| GB | 2423863 | A | 9/2006 |
| GB | 2454762 | A | 5/2009 |
| GB | 2465067 | A | 5/2010 |
| SU | 702430 | A1 | 12/1979 |
| WO | 2001013100 | A2 | 2/2001 |
| WO | 2004010209 | A1 | 1/2004 |
| WO | 2005067000 | A2 | 7/2005 |
| WO | 2007010272 | A2 | 1/2007 |
| WO | 2008129751 | A1 | 10/2008 |
| WO | 2009110025 | A1 | 9/2009 |
| WO | 2010141776 | A2 | 12/2010 |
| WO | 2013140139 | A2 | 9/2013 |

OTHER PUBLICATIONS

Search Report for GB Application No. 1608476.6 dated Sep. 19, 2016, 4 pages.

Combined Search and Examination Report for GB Application No. 1707756.1 dated Oct. 12, 2017, 7 pages.

* cited by examiner

ION GUIDE

CROSS-REFERENCE TO RELATED APPLICATIONS

This application is a national phase filing claiming the benefit of and priority to International Patent Application No. PCT/GB2017/051348, filed on May 15, 2017, which claims priority from and the benefit of United Kingdom patent application No. 1608476.6 filed on May 13, 2016. The entire contents of these applications are incorporated herein by reference.

FIELD OF THE INVENTION

The present invention relates generally to mass or ion mobility spectrometers and in particular to ion guiding devices.

BACKGROUND

Ion guiding devices are widely employed in mass spectrometers to transport ions efficiently, and without loss, through the different regions of the instrument. For instance, ion guides may be used to transport ions between various regions of different pressures, e.g. from high or atmospheric pressures in the source region into the high vacuum stages of the instrument containing the analyser (typically operating at pressures of about $10^{-5}$ to $10^{-9}$ mbar).

One known type of ion guide is a so-called stacked ring ion guide ("SRIG") comprising a plurality of axially stacked electrodes each having an aperture formed therein through which ions are transmitted in use. SRIG devices can be constructed relatively inexpensively, simply by slotting the electrodes into their axial positions on a suitable holder.

Furthermore, because the electrodes are axially stacked and spaced apart from each other, SRIG devices allow the possibility of selectively applying different DC potentials to each of the electrodes such that axial fields can be applied across a portion of the device. For instance, this allows the implementation of travelling wave techniques, where ions are driven along the length of the ion guide by translating a series of axial potential wells along the ion guide, in order to increase the speed of transfer of ions through these regions. Travelling wave techniques are particularly advantageous for clearing ions from an ion guide quickly, as the ions can be translated along the ion guide without requiring high DC gradients that may take a significant time to stabilise after being ramped and/or may introduce unwanted ion activation in the downstream components.

In a SRIG device alternate RF phases are applied to adjacent electrodes (i.e. +−+−) in order to confine the ions radially, but only one RF phase (i.e. + or −) is applied to each of the electrodes.

Another known type of ion guide is a quadrupole ion guide comprising a set of four parallel rods arranged in a quadrilateral array, with adjacent rods being connected to alternate RF phases and opposite rods connected to the same RF phase. Thus, both RF phases (+ and −) must be present at each axial position along the length of the quadrupole ion guide. The resulting quadrupole field generally provides better focussing, i.e. focusses ions closer to the central axis, than a SRIG device. Quadrupole ion guides may therefore allow the use of smaller differential apertures between different vacuum stages, which may in turn allow for the use of smaller, less expensive pumps. Alternatively, quadrupole ion guides may allow more ions to be focussed through an aperture of a given size.

However, the voltage requirements for quadrupoles are much higher than with SRIGs, especially for larger $r_0$ values, where quadrupoles require much higher voltages than equivalently sized SRIGs, and so the effect of variations in frequency, and interference may be more significant. This can lead to difficulties in terms of providing both phases of the RF voltages to the rods without breakdown or interference. Quadrupoles must therefore generally be manufactured with a high amount of precision, and are typically harder and more expensive to manufacture and maintain than SRIG devices. Furthermore, it is difficult to implement travelling waves on a quadrupole rod set. Although segmented rod sets are known, which allow axial DC gradients to be applied along the length of the device, typically adjacent segments of the rod set are still coupled, e.g. to form a resistive network, and the axial segments are not independent of each other.

It is therefore desired to provide an improved ion guiding device.

SUMMARY

According to an aspect there is provided an ion guiding device comprising a plurality of axially stacked plates, wherein at least some or all of the plates comprise:

a first electrically conductive portion; and a second electrically conductive portion, wherein the second electrically conductive portion is electrically isolated from the first electrically conductive portion, the first and second electrically conductive portions being shaped and arranged relative to each other so as to define an opening through which ions are axially transmitted in use;

wherein, in use, a first AC or RF voltage is applied to the first electrically conductive portion and a second AC or RF voltage is applied to the second electrically conductive portion of the plate in order to confine ions radially within the opening.

The ion guiding device comprising a plurality of separate axially stacked plates facilitates a relatively simple, and cheap, construction, e.g. as described above for known SRIG-type ion guides. Furthermore, by having separate axially spaced plates, different potentials may be applied to different plates in the axial stack allowing more control of the axial fields, and e.g. advantageously enabling travelling wave techniques to be implemented. However, in contrast to conventional axially stacked ion guides (or SRIGs), in the present ion guiding device each axial plate is formed of first and second electrically isolated conductive portions, allowing first and second AC or RF voltages to be separately maintained on each plate. Thus, the ion guiding device allows better focussing fields to be provided that confine the ions more closely to the centre of the device. By having the first and second electrically conductive portions electrically isolated from each other the first and second AC or RF voltages (or voltage supplies) can also be kept physically separate from each other, and e.g. provided via separate circuitry, thereby reducing the risk of any breakdown, changes in capacitance, or other interference.

Hence, compared to conventional SRIGs the ion guiding devices described herein may allow relatively more complex (e.g. quadrupole type) confining fields to be generated, whilst still maintaining the benefit of being relatively inexpensive to manufacture and the ability to implement e.g. travelling wave techniques for driving the ions axially along the device. Particularly, the techniques and devices described herein allow for a relatively compact ion guiding device with an improved confinement to be provided (e.g. due to the first and second AC or RF voltages applied at each axial position) and with the ability to implement arbitrary axial fields, including e.g. travelling waves (e.g. due to the axial stack of plates).

It will be understood that each of the plurality of axially stacked plates may be arranged at a fixed axial position along the length of the ion guiding device. Hence, the first and second electrically conductive portions constituting a plate may be located at substantially the same axial position or overlap axially at this position. In use, ions are therefore confined radially within the opening by the first and second AC or RF voltages at this axial position, i.e. or in the region of overlap.

It will be appreciated that the plates are stacked axially, i.e. along the length of the ion guiding device in the direction that ions are transmitted in use. The openings defined by adjacent plates thus define an ion guiding region of the ion guiding device through which ions are transmitted axially in use. By "radially" therefore, it is meant any direction orthogonal to the axial direction, e.g. horizontally or vertically, or both. The radial confinement of the ions may be symmetric or asymmetric.

The plurality of axially stacked plates may be physically separated and spaced apart from each other in the axial direction. The plurality of axially stacked plates may be arranged and/or provided with electrical connections such that separate DC voltages can be applied individually to each plate.

Each of the first and second electrically conductive portions may be unitary or integrally formed, so that the first and second AC or RF voltages are applied to the whole of the first and second electrically conductive portions at once.

Each of the plurality of plates in the axial stack may have essentially the same shape, i.e. each plate may comprise the same type of first and second electrically conductive portions. However, it is also contemplated that the plurality of axially stacked plates may comprise differently shaped plates, having different first and second electrically conductive portions. For instance, the plates in the axial stack may be arranged such that the size and/or shape of the openings, and hence of the ion guiding region, progressively varies, increases or decreases along the length of the device.

The ion guiding device may generally be an ion guiding device for use in a mass or ion mobility spectrometer. The ion guiding device is not limited to a device that merely guides or confines ions, but may also be used to manipulate, or activate ions.

The first and/or second AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The first and/or second AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The ion guiding device may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

The first electrically conductive portion and the second electrically conductive portion may be separately formed and interleaved with each other to define the or each plate.

That is, each of the at least some plates in the axial stack may comprise two separate portions arranged or mounted in an interleaved arrangement such that the first and second electrically conductive portions are or overlap at the same axial position.

Alternatively, the first electrically conductive portion and the second electrically conductive portion may be formed on a single substrate. Optionally, the first electrically conductive portion and the second electrically conductive portion may be printed on the substrate. For instance, the first and second electrically conductive portions may be printed using existing printed circuit board ("PCB") techniques.

The first electrically conductive portion and the second electrically conductive portion may be shaped and arranged relative to each other such that, in use, the first AC or RF voltage and the second AC or RF voltage generate a multipole field, and optionally a quadrupole field.

For example, in order to generate a quadrupole field, the first and second electrically conductive portions may be shaped so that the opening is defined between two opposing portions of the first electrically conductive portion (i.e. having the same AC or RF voltage) and two opposing portions of the second electrically conductive portion (i.e. also having the same AC or RF voltage), with the portions of the first and second electrically conductive portions arranged adjacent to each other around the opening. The two opposing portions of the first electrically conductive portion and the two opposing portions of the second electrically conductive portion may thus be arranged in a substantially quadrilateral array. The (or portions of the) first and second electrically conductive portions may overlap in the radial, horizontal or vertical directions. In a similar manner, the first and second electrically conductive portions may be shaped so as to define a substantially hexagonal or octagonal array of alternately phased portions around the opening suitable for generating hexapole or octapole fields.

The first electrically conductive portion may comprise a first electrical connection portion for receiving the first AC or RF voltage and the second electrically conductive portion may comprise a second electrical connection portion for receiving the second AC or RF voltage, wherein the first electrical connection portion and the second electrical connection portion are located on opposite sides of the ion guiding device.

The first and second electrical connection portions may, in use, be connected to first and second AC or RF voltage sources, respectively, for supplying the first and second AC or RF voltages.

By having the electrical connections for the first and second AC or RF voltages made on opposite sides of the ion guiding device, the electrical connections for the first AC or RF voltage and the second AC or RF voltage can be kept separate from each other reducing the risk of breakdown, changing capacitance, or other interference. For example, the connections to the first AC or RF voltage source may be made using one support or construction plate and the connections to the second AC or RF voltage source may be made using a separate, or opposite support or construction plate. The support or construction plates used for the electrical connections may typically be the support or construction plates between which the plates are physically mounted. For example, the support or construction plates may generally define the lateral sides of the ion guide, with the ions being transmitted in use along the axis parallel to the support or construction plates. The support or construction plates may comprise PCBs allowing for both mechanical and electrical connections to the axially stacked plates. Thus, the axially stacked plates, being mounted to the support or construction plates, provide structural stability to the ion guide. That is, the axially stacked plates (i.e. the electrodes of the ion guide) themselves provide the mechanical structure of the ion guide.

In this way, only a single AC or RF voltage need be applied to each support or construction plate. The separation of the AC or RF voltages onto separate (e.g. opposite) support or construction plates may benefit the construction of the ion guide. For example, the separation of the AC or RF voltages onto separate support or construction plates may reduce the requirements for creepage and/or clearance. This may in turn facilitate the use of smaller support or construction plates which may provide greater options for modifying the form of the ion guide. In addition, separating the AC or RF phases may result in a reduction in the capacitance of the ion guide, making it easier to achieve higher AC or RF frequencies.

Each of the plurality of axially stacked plates may further comprise a DC electrical connection for connecting the plate to one or more DC voltage source for generating, in use, one or more DC voltages or fields, and optionally enabling one or more transient DC voltages or potential wells to be applied to the plates, for transporting or urging ions axially along the ion guiding device.

That is, in use, each of the axially stacked plates may be held at a different DC potential. For example, in use, one or more transient DC voltages or potential wells may be applied sequentially to adjacent plates in order to drive ions axially through the ion guiding device.

Each of the plates and/or each of the electrically conductive portions may be individually mounted in position within a housing.

The housing may comprise a pair of spaced-apart support plates, wherein each of the plates and/or each of electrically conductive portions are individually mounted between the spaced-apart support plates. The spaced-apart support plates may be laterally or horizontally spaced-apart perpendicular to the axis of the ion guide.

The first AC or RF voltage may be applied via one of the spaced-apart support plates and the second AC or RF voltage may be applied via the other of the spaced-apart support plates. That is, the first AC or RF voltage may be applied only to one of the spaced-apart support plates, i.e. only on one side of the ion guide, whereas the second AC or RF voltage may be applied only to the other of the spaced-apart support plates, i.e. only on the other side of the ion guide.

Thus, each of the plates may be fixed axially in position within the housing. The plates may be fixed within the housing using connecting portions or pins. The connecting portions or pins may be unitary with the electrically conductive portions, or with a substrate on which the electrically conductive portions are provided, where such substrate is provided. These connecting portions or pins may provide both a mechanical connection helping to lock the plates in position and allow an electrical connection to a voltage supply.

According to another aspect there is provided a mass or ion mobility spectrometer comprising an ion guiding device substantially as described above.

The mass or ion mobility spectrometer may generally comprise an ion source and a mass or ion mobility analyser. The mass or ion mobility spectrometer may further comprise one or more AC or RF and/or DC voltage sources for supplying AC or RF and/or DC voltages to each of the plates and/or the electrically conductive portions.

According to another aspect there is provided a method of constructing an ion guiding device comprising:

providing a plurality of plates, wherein at least some or all of the plates comprise a first electrically conductive portion and a second electrically conductive portion, the second electrically conductive portion being electrically isolated from the first electrically conductive portion, so that, in use, a first AC or RF voltage can be applied to the first electrically conductive portion(s) and a second AC or RF voltage can be applied to the second electrically conductive portion(s) in order to confine ions within the ion guiding device, wherein the first and second electrically conductive portions are shaped so as to define an opening through which ions are transmitted axially in use; and arranging the plurality of plates into an axial stack.

The first electrically conductive portions and the second electrically conductive portions may be separately formed, and arranging the plurality of plates into an axial stack may comprise interleaving the first and second electrically conductive portions.

The first and second electrically conductive portions may be formed using a metal injection moulding process.

Alternatively, providing the plurality of plates may comprise printing the first and second electrically conductive portions onto a substrate.

According to another aspect there is provided a method of guiding ions, comprising:

providing an ion guiding device substantially as described herein;

applying a first AC or RF voltage to the first electrically conductive portions and applying a second AC or RF voltage to the second electrically conductive portions to confine ions within the ion guiding device; and passing ions through the ion guiding device.

Passing ions through the ion guiding device may comprise driving or urging ions through the ion guiding device using one or more DC voltages or fields, and optionally using one or more transient DC voltages or potential wells.

The method may comprise applying different DC voltages or fields to each of the plates in the axial stack.

According to another aspect there is provided a method of mass or ion mobility spectrometry comprising a method substantially as described herein.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more further ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

The techniques described herein utilise, in embodiments, relatively simple stacked ring type construction techniques in order to provide a cheap ion guide that allows practically arbitrary confinement fields to be generated. For example, in embodiments, the techniques described herein may use stacked ring type constructions techniques to provide a cheap quadrupole type ion guide. In particular, the techniques described herein allow the ion guide to be manufactured relatively easily, and inexpensively, whilst allowing better radial confinement using multiple AC or RF phases at each axial position (i.e. on each plate), and still maintaining the first and second AC or RF voltages separate to reduce any risk of interference. For instance, the first and second AC or RF voltages may be maintained separately on different circuit boards, or different construction or supporting plates of the ion guide housing. Furthermore, because the ion guide comprises a plurality of stacked plates, the DC potentials applied to each of the plates may be controlled independently such that it is easy to generate axial DC fields or e.g. employ DC travelling waves to transport the ions axially along the ion guide.

Although the embodiments are described in relation to an ion guide, it will be appreciated that the techniques and devices described herein are not limited to devices merely having an ion guiding function, and may be extended to any device in which ions are radially confined or guided using AC or RF voltages, generally "ion guiding devices". For instance, by operating the device with appropriate voltages and/or pressures, the device may also be used to manipulate the ions that are being guided. The device may e.g. therefore comprise an ion reaction or fragmentation device, or an ion separation, trapping or filtering device, so long as there is some ion guiding functionality.

Figure 1:
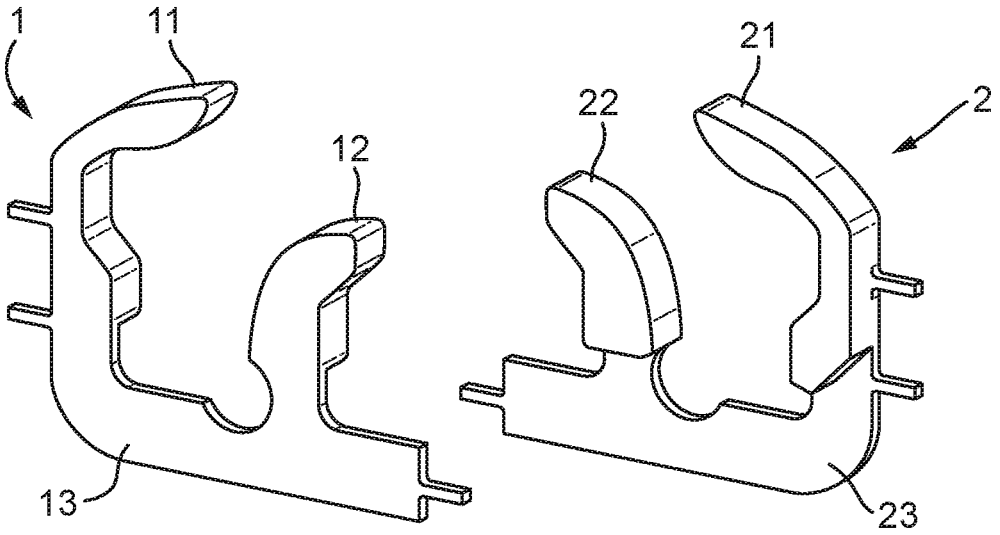
FIG. 1 shows a pair of electrodes for use in constructing an ion guide according to an embodiment.

FIG. 1 illustrates a pair of electrodes 1,2 that may be interleaved to define a single plate for use in the ion guide according to an embodiment. The electrodes 1,2 are shaped such that when they are interleaved, the electrodes are physically separated from, and hence electrically isolated from, each other. For example, as shown in FIG. 1, the first electrode 1 has a base portion 13, and two extensions 11,12 extending away from the base portion 13 in the z-direction, or the axial direction of the ion guiding device. The second electrode 2 has a corresponding base portion 23 and extensions 21,22 that extend away from the base portion. Thus, when the two electrodes 1,2 are brought into interleaved arrangement, the base portions 13,23 are offset axially from each other by a gap, the gap essentially corresponding to the axial thickness of the extensions. However, in the interleaved arrangement, the extensions extend into this gap, such that the extensions all share essentially the same axial position. That is, the extensions 11,12 of the first electrode 1 and the extensions 21,22 of the second electrode 2 overlap in the axial direction. This overlap defines the axial position (and extent) of the plate that is defined by the pair of corresponding first 1 and second 2 electrodes. The extensions are shaped and arranged relative to each other such that when the electrodes are interleaved the region between the extensions defines an opening through which ions can pass axially.

The first electrode 1 may comprise a unitary structure and may be integrally formed such that the base portion 13 and the extensions 11,12 are all physically connected. Similarly, the second electrode 2 may also comprise a unitary structure. However, the two electrodes 1,2 are not physically or electrically connected to each other, and so a first AC or RF phase may be applied to the first electrode 1 and a second AC or RF voltage phase may be separately applied to the second electrode 2. Thus, it will be appreciated that the techniques described herein allow two separate AC or RF voltage phases to be maintained at each axial position along the length of the ion guide (i.e. on each plate), such that relatively complex radial confinement fields can be generated. In general, the extensions of the first and second electrodes may be shaped and arranged relative to each other in any desired configuration, allowing a great amount of freedom in defining the shape of the opening, and the positions at which the AC or RF voltages are applied, and hence the shape of the confining field.

Figure 3:
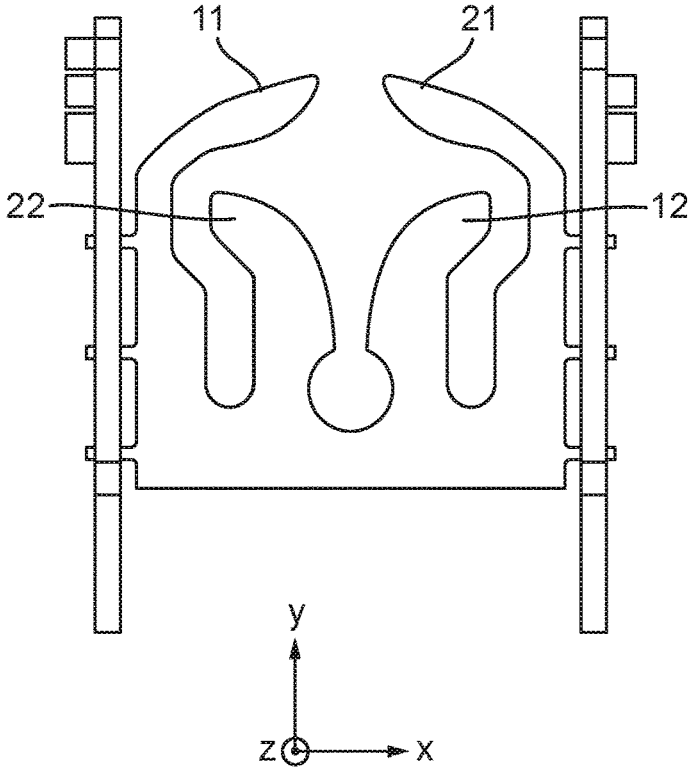
FIG. 3 shows the ion guide shown in FIG. 2 in cross-section along the axis of the guide.

In the embodiment illustrated in FIG. 1, when the electrodes 1,2 are interleaved, the extensions 11,12 of the first electrode 1 are arranged opposite each other across the radial direction of the opening. Similarly, the extensions 21,22 of the second electrode 2 are also arranged opposite each other across the radial direction of the opening. Hence, the extensions of the first electrode are adjacent the extensions of the second electrode going circumferentially around the opening. The extensions of the first electrode may be arranged to overlap with the extensions of the second electrode in the radial (i.e. x- and/or y-) directions, as best illustrated in FIG. 3, to define the opening.

Thus, the two extensions 11,12 of the first electrode 1, which are arranged opposite each other across the radial direction of the opening, are connected to the first AC or RF voltage phase, whereas the two extensions 21,22 of the second electrode 2, which are arranged opposite each other across the radial direction of the opening, are connected to the second AC or RF voltage phase. Thus, when a plurality of first and second electrodes are arranged together into an axial stack, the two extensions 11,12 of each first electrode 1 may be connected in phase with, to the same first AC or RF voltage, as the corresponding two extensions 11,12 of the axially adjacent first electrodes 1 in the stack. Similarly, the two extensions 21,22 of each second electrode 2 may be connected in phase, to the same second AC or RF voltage, as the corresponding extensions 21,22 of the axially adjacent second electrodes in the stack. This configuration allows a quadrupole field to be set up, as the extensions are arranged relative to each other, and the AC or RF voltage phases are applied to the extensions, in a similar manner to the individual rods in a quadrupole rod set. Unlike a quadrupole rod set, however, it will be appreciated that in the ion guiding devices described herein, the two extensions 11,12 of the first electrode 1 are interconnected due to the unitary structure of the first electrode 1 (as are the two extensions 21,22 of the second electrode 2). Thus, the extensions are merely different portions of the electrodes, defined by the shape of the electrode, and are necessarily supplied with the same AC or RF voltage.

Figure 2:
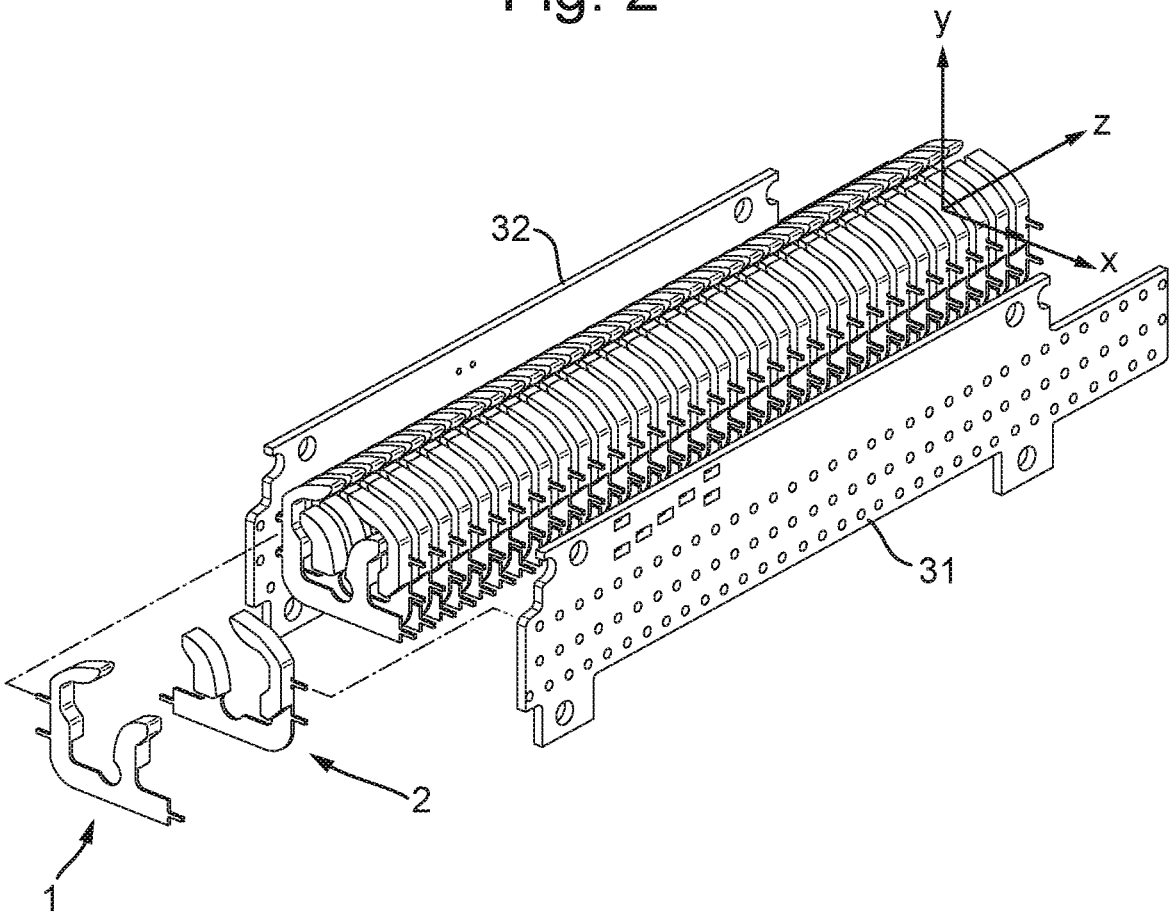
FIG. 2 shows an ion guide construction using the electrodes of the type shown in FIG. 1.

FIG. 2 shows an ion guide constructed using a plurality of plates arranged in an axial stack, each plate comprising a pair of interleaved electrodes of the type shown in FIG. 1.

As shown in FIG. 2, the electrodes 1,2 are each physically mounted within a housing that acts to securely hold the electrodes in their axial position. As shown in FIGS. 1 and 2, the electrodes 1,2 may each have connecting portions extending out of the electrodes in the x direction for slotting into corresponding receiving portions provided in the housing 31,32. The housing may comprise a first supporting substrate 31 and a second supporting substrate 32 spaced apart from the first supporting substrate in the horizontal (x-) direction. The supporting substrates 31,32 may e.g. comprise printed circuit boards ("PCB") that allow both mechanical and electrical connections to be made to the electrodes 1,2. Thus, the electrodes 1,2 themselves provide structural stability to the ion guide and define the mechanical structure of the ion guide.

For instance, as shown in FIG. 1, the electrodes 1,2 may comprise connecting portions or pins extending horizontally outwardly from the base portions. Generally, the electrodes may comprise connecting portions or pins extending horizontally outwardly from both sides so that the electrodes are held in place between the first and second supporting substrates on both sides. In FIG. 1, each of the electrodes has two connecting portions on one side and a single connecting portion on the opposite side. Naturally, various other arrangements of connecting portions or connecting mechanisms suitable for holding the electrodes in place relative to the housing may also be used. For instance, the base portions of the electrodes may be received within a groove provided within the housing.

The first electrode 1 may be electrically connected to a first AC or RF voltage source for supplying the first AC or RF voltage phase in various ways. The electrical connection to the first electrode 1 may be made using one of the (mechanical) connecting portions described above. For example, one of the connecting portions on one side of the first electrode 1 may be connected to the supporting substrate 32 such that an electrical connection is made, e.g. via an electrically conductive track provided on the supporting substrate 32. The other connecting portions of the first electrode 1 may be connected to ground or to other voltage sources (e.g. for supplying a DC voltage). Each of the first electrodes 1 in the stack of plates may be connected to the same first AC or RF voltage source. A second AC or RF voltage source for supplying the second AC or RF voltage phase may be electrically connected to the second electrode 2. This may be done similarly to the electrical connection for the first electrode 1. That is, the second electrodes 2 may be electrically connected to the second AC or RF voltage source via a supporting substrate 31, and particularly via the supporting substrate 31 that defines the other side of the ion guide to the supporting substrate 32 that acts to provide the first AC or RF voltage to the first electrodes 1. Thus, where the electrical connection between the first AC or RF voltage source and the first electrode 1 is made on one side, e.g. via the first supporting substrate 32, the electrical connection between the second AC or RF voltage source and the second electrode 2 made be made on the other side, e.g. via the second supporting substrate 31. In this way, each side of the housing, i.e. each supporting substrate 31,31, need only be connected to a single AC or RF voltage source or phase (rather than both sides of the housing being connected to both phases), thus reducing the risk of interference or electrical breakdown. In particular, by physically separating the first and second AC or RF voltage sources on opposite sides of the ion guide the capacitance of the ion guide may be reduced, making it easier to achieve higher AC or RF frequencies. Similarly, separating the first and second AC or RF voltages in this way may reduce the creepage and/or clearance requirements.

The first and second AC or RF voltage sources may be provided by a common AC or RF voltage source with suitable circuitry for splitting the signal and introducing a phase difference, or separate AC or RF voltage sources may be provided.

It will be appreciated that this type of stacked plate construction is relatively simple, as the individual plates (i.e. or electrodes 1,2) can easily be slotted and fixed axially in position along the length of the ion guiding region. It will also be appreciated that electrodes of the type shown in FIG. 1 may readily be designed to fit into existing SRIG constructions by providing suitably shaped connecting portions with minimal change in supporting architecture, mechanical or electrical connectivity, electronic circuitry, etc.

Furthermore, the physical separation of the first and second AC or RF voltages to opposite sides of the ion guide may make it easier to apply DC travelling waves to the ion guide for transporting or clearing ions from the ion guide. Separating the first and second AC or RF voltages onto separate electrodes 1,2 removes the need to apply the travelling wave potential to the electrodes for both phases thus removing the complication of having to link the electrodes whilst keeping the opposite phases sufficiently spaced apart. Thus, the use of the interleaved electrodes allows travelling waves to be applied in an analogous manner to conventional stacked ring electrodes wherein one phase is applied to one of the supporting plates 32 and the other phase is applied on the other supporting plate 31. Thus, the techniques described herein may facilitate the construction of a travelling wave-enabled quadrupole ion guide.

FIG. 3 shows an ion guide of the type shown in FIG. 2 in cross section along the axial length of the device. As shown in FIG. 3, the extensions 11,12,21,22 of the interleaved electrodes 1,2 define an opening through which ions may be axially transmitted in use along the length of the ion guide. The extensions are arranged around this opening such that applying a first AC or RF voltage phase to the extensions 11,12 of the first electrode 1 and a second AC or RF voltage phase to the extensions 21,22 of the second electrode 2 generates a quadrupole confining field that acts to confine ions radially within the opening.

Although the embodiments described above in relation to FIGS. 1-3 show two interleaved electrode portions each having two extensions that may e.g. be suitable for generating a quadrupole field, it will be appreciated that the techniques described herein may readily be extended to generate various other radially confining fields. For example, each plate may comprise more than two interleaved electrode portions, allowing further (i.e. three or more) AC or RF phases or voltages to be applied at each axial position. Similarly, each electrode may comprise more than two extensions in various shapes and relative arrangements. In this way, the interleaved electrodes may be used to generate any multipole ion guide, for instance, a hexapole or octopole ion guide, or combinations thereof.

Similarly, although FIG. 2 shows an ion guide formed of a plurality of equally shaped electrodes 1,2, such that the ion guiding region along which ions are transmitted, as defined by the respective openings in the plates, has a constant cross-section, it is also contemplated that plates and/or electrodes having various different shapes and arrangements may be incorporated into the ion guide. For example, the shapes and relative positions of the extensions of the electrodes defining adjacent plates may be arranged so that the size of the opening progressively varies along the length of the ion guide, e.g. to provide an ion funnel type ion guide. As another example, the shapes and relative positions of the extensions of the electrodes may be arranged to provide distinct openings, allowing multiple ion guiding paths throughout the length of the ion guide. The electrodes 1,2 may be manufactured using a metal injection moulding ("MIM") process. It will be appreciated that MIM may allow electrodes of essentially arbitrary shapes to be formed relatively inexpensively. However, it will also be appreciated that various other manufacturing techniques may suitably be used to form the electrodes. For example, the electrodes may be die-cast or 3D-printed. As another example, first and second electrically conductive portions may be printed on a pair of insulating substrates to define the first and second electrodes, with the substrates then being interleaved to define the axial stack of plates. Again, the first and second electrically conductive portions are electrically isolated from each other, so that separate AC or RF phases can be applied thereto. The electrically conductive portions may thus be shaped similarly to the extensions illustrated in FIG. 1 to provide a quadrupole (or any other desired) confining field. It is contemplated that various suitable printing techniques may be used, for instance, those described below in relation to FIG. 4.

Figure 4:
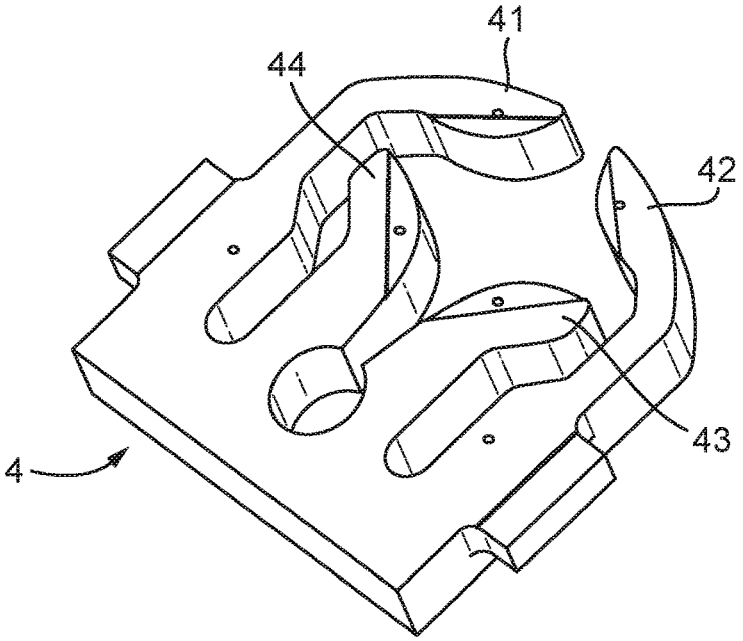
FIG. 4 shows an electrode for use in constructing an ion guide according to another embodiment.

FIG. 4 shows another embodiment where the first and second electrically conductive portions are provided as separate tracks or regions on a single substrate that defines a plate 4 for use in a stacked plate ion guide. A plurality of these plates or substrates may be stacked axially to form the ion guide in an analogous manner described above in relation to FIG. 2.

The first and second electrically conductive portions may, for instance, be printed or otherwise deposited onto the substrate using various suitable printing and/or etching techniques. As one example, the first and second electrically conductive portions may be formed using conventional PCB manufacturing techniques. The first and second electrically conductive portions may be printed on separate layers of the substrate or otherwise printed in a pattern that keeps the first and second electrically conductive portions isolated from each other, and that allows separate AC or RF phases to be applied to the first and second electrically conductive portions. Typically, the substrate will be an insulating material, such as in a conventional PCB construction.

The plate 4 shown in FIG. 4 has essentially the same shape as the plate defined by the two interleaved electrodes illustrated in FIG. 1, and similarly defines an axial opening through which ions may be transmitted in use, with the opening surrounded by two extensions 41,43 opposite each other across the radial direction of the opening and provided by the first electrically conductive portion and two extensions 42,44 opposite each other across the radial direction of the opening and provided by the second electrically conductive portion. As with the embodiment described in relation to FIGS. 1-3, it will be appreciated that the embodiment shown in FIG. 4 allows multiple AC or RF phases to be applied at a single axial position within a stacked plate type ion guide construction by applying different AC or RF voltages to the first and second electrically conductive portions. Again therefore, this may provide an ion guide with a relatively simple and cheap manufacture, having both strong radial confinement and the ability to apply separate potentials at different axial positions, e.g. to implement travelling waves. The mechanical and electrical connections of the plates 4 may be made in various ways, similarly to the embodiment shown in FIGS. 1-3.

As described above in relation to the previous embodiment, the plates 4 may generally have connecting portions extending horizontally outwardly of the plates for physically connecting with a housing in order to hold the plates axially in position. The electrical connections for the first and second electrically conductive portions may also be made using these protrusions. The electrical connection for the first electrically conductive portion may be made on one side of the plate 4, and the electrical connection for the second electrically conductive portion may be made on the opposite side of the plate 4 to reduce the risk of the first and second AC or RF phases interfering with each other.

Although the present invention has been described with reference to preferred embodiments, it will be understood by those skilled in the art that various changes in form and detail may be made without departing from the scope of the invention as set forth in the accompanying claims.

The invention claimed is:

1. An ion guiding device having a length, where in use ions are transmitted along the length of the ion guiding device, the ion guiding device comprising a plurality of axially stacked plates, stacked axially along the length of the ion guiding device in the direction that ions are transmitted in use wherein at least some or all of said plates comprise:

a first electrically conductive portion; and a second electrically conductive portion, wherein the second electrically conductive portion is electrically isolated from the first electrically conductive portion, the first and second electrically conductive portions being shaped and arranged relative to each other so as to define an opening through which ions are axially transmitted in use;

wherein each of the plates and/or each of the electrically conductive portions are individually mounted between a pair of spaced-apart support plates; and wherein, in use, a first AC or RF voltage is applied to the first electrically conductive portion and a second AC or RF voltage is applied to the second electrically conductive portion in order to confine ions radially within said opening, wherein said first AC or RF voltage is applied via only one of said spaced-apart support plates and wherein said second AC or RF voltage is applied via only the other of said spaced-apart support plates.

2. An ion guiding device as claimed in claim 1, wherein said first electrically conductive portion and said second electrically conductive portion are separately formed and interleaved with each other to define said plates.

3. An ion guiding device as claimed in claim 1, wherein said first electrically conductive portion and said second electrically conductive portion are formed on a single substrate, optionally wherein said first electrically conductive portion and said second electrically conductive portion are printed on said substrate.

4. An ion guiding device as claimed in claim 1, wherein said first electrically conductive portion and said second electrically conductive portion are shaped and arranged relative to each other such that, in use, said first AC or RF voltage and said second AC or RF voltage generate a multipole confining field, and optionally a quadrupole confining field.

5. An ion guiding device as claimed in claim 1, wherein said first electrically conductive portion comprises a first electrical connection portion for receiving said first AC or RF voltage and wherein said second electrically conductive portion comprises a second electrical connection portion for receiving said second AC or RF voltage, wherein said first electrical connection portion and said second electrical connection portion are located on opposite sides of the ion guiding device.

6. An ion guiding device as claimed in claim 1, wherein each of said plurality of axially stacked plates further comprises a DC electrical connection for connecting said plate to one or more DC voltage source for generating, in use, one or more DC voltages or fields, and optionally enabling one or more transient DC voltages or potential wells to be applied to said plates, for transporting or urging ions axially along the ion guiding device.

7. A mass or ion mobility spectrometer comprising an ion guiding device as claimed in claim 1.

8. A method of constructing an ion guiding device having a length, where in use ions are transmitted along the length of the ion guiding device, the method comprising:

providing a plurality of plates, wherein at least some or all of said plates comprise a first electrically conductive portion and a second electrically conductive portion, the second electrically conductive portion being electrically isolated from the first electrically conductive portion, so that, in use, a first AC or RF voltage can be applied to the first electrically conductive portion(s) and a second AC or RF voltage can be applied to the second electrically conductive portion(s) in order to confine ions within said ion guiding device, wherein the first and second electrically conductive portions are shaped so as to define an opening through which ions are transmitted axially in use; and arranging said plurality of plates into an axial stack, wherein the plurality of plates are stacked axially along the length of the ion guiding device in the direction that ions are transmitted in use, and wherein each of the plates and/or each of the electrically conductive portions are individually mounted between a pair of spaced-apart support plates so that said first AC or RF voltage can be applied via only one of said spaced-apart support plates and said second AC or RF voltage can be applied via only the other of said spaced-apart support plates.

9. A method as claimed in claim 8, wherein said first electrically conductive portions and said second electrically conductive portions are separately formed, and wherein arranging said plurality of plates into an axial stack comprises interleaving said first and second electrically conductive portions.

10. A method as claimed in claim 9, wherein said first and second electrically conductive portions are formed using a metal injection moulding process.

11. A method as claimed in claim 8, wherein providing said plurality of plates comprises printing said first and second electrically conductive portions onto a substrate.

12. A method of guiding ions, comprising:

providing an ion guiding device as claimed in claim 1;

applying a first AC or RF voltage to said first electrically conductive portions and applying a second AC or RF voltage to said second electrically conductive portions to confine ions within said ion guiding device; and passing ions through said ion guiding device.

13. A method as claimed in claim 12, wherein the step of passing ions through said ion guiding device comprises driving or urging ions through said ion guiding device using one or more DC voltages or fields, and optionally using one or more transient DC voltages or potentials.

14. A method of mass or ion mobility spectrometry comprising a method as claimed in claim 13.

* * * * *